US006069307A

United States Patent [19]

Rogers

[11] Patent Number: 6,069,307

[45] Date of Patent: May 30, 2000

[54] INFLATABLE MUSICAL DRUM

[75] Inventor: Thomas P. Rogers, Cranford, N.J.

[73] Assignee: RTOM Corporation, Englewood, N.J.

[21] Appl. No.: 09/236,533

[22] Filed: Jan. 25, 1999

[51] Int. Cl.[7] ..... G10D 13/02

[52] U.S. Cl. ..... 84/411 R; 84/413

[58] Field of Search ..... 84/411 R, 413

[56] References Cited

U.S. PATENT DOCUMENTS 635,192 10/1899 Sapp ..... 84/411 R
4,549,462 10/1985 Hartry et al. ..... 84/413

*Primary Examiner*—Robert E. Nappi
*Assistant Examiner*—Shih-yung Hsieh
*Attorney, Agent, or Firm*—Hedman, Gibson Costigan, P.C.

[57] ABSTRACT

A musical drum in which an inflatable bladder is employed to regulate the tension on the drum head.

17 Claims, 5 Drawing Sheets

INFLATABLE MUSICAL DRUM

FIELD OF THE INVENTION

This invention relates to musical drums in general and, in particular, to practice and conventional drums that can be tensioned to the desired pitch by an inflatable bladder.

BACKGROUND OF THE INVENTION

Musical instrument drums have long been known and require fundamentally that the drum be comprised of a body and a drumhead with means to tension the drumhead to an appropriate tension to provide the sound and acoustics that the particular drummer desires.

Conventional acoustic drums are generally comprised of a body having a lug and tension rod system arranged to impose a force upon the top drumhead and bottom drumhead. As the tension rod is tightened, pressure is imposed on the means mounting the drumheads, usually a circular continuous rim with an epoxy to secure the edges of the drumhead.

In addition, practice drums have been developed to enable the musician to develop his skills without the sound attending a typical acoustic drum. Practice drums take the form of heads or pads with little or no tension, and generally means whereby a drumstick can strike a surface and create very little or no sound.

SUMMARY OF THE INVENTION

The present invention is an inflatable bladder assembly adapted to provide either a practice drum or a conventional drum with means to enable the musician to tension the assembly to his desired pitch. In essence, the system is comprised of a circular bladder that can be inflated, preferably a pneumatic bladder, and a rigid assembly having a surface against which the inflatable bladder bears and a second surface against which the drumhead bears. As the pneumatic tube is inflated, the tube expands imposing a pressure on the surface which is transmitted to the drumhead and further causing a tension of increased magnitude on the head.

In the contemplated practice head, the assembly is comprised essentially of a drumhead secured to a circular wall mounting the drumhead, an interior peripheral pneumatic bladder and a pressure plate structure resting on the inflatable bladder that provides direct connection between the bladder and the mesh head. In essence the pressure plate structure is a solid structure circular in shape having a surface bearing on the inflatable bladder with an extension projecting from the surface bearing on the inflatable bladder to the bottom of the mesh head that provides the means for imposing the tension on the mesh head. In addition the practice drum has a peripheral D-shaped gasket that provides effectively a force fit between the practice drum head and the counter hoop of a conventional drum.

The acoustic drum of the present invention is a musical drum comprised of a conventional body, a top head and bottom head secured to the drum body and an assembly of an inflatable bladder and pressure plate means to transmit force generated by inflation of the inflatable bladder to the top and bottom heads.

DESCRIPTION OF THE DRAWINGS

The invention will be better understood when viewed in combination with the description of the preferred embodiment and the following drawings wherein.

DESCRIPTION OF THE PREFERRED EMBODIMENT

The inflatable bladder assembly of the present invention has application in both practice drums and performance drums. If it is desired to use the drum of the present invention as a performance drum a solid head covering is used. If it is desired to use the drum of the present invention as a practice drum a mesh head covering is contemplated.

Figure 1:
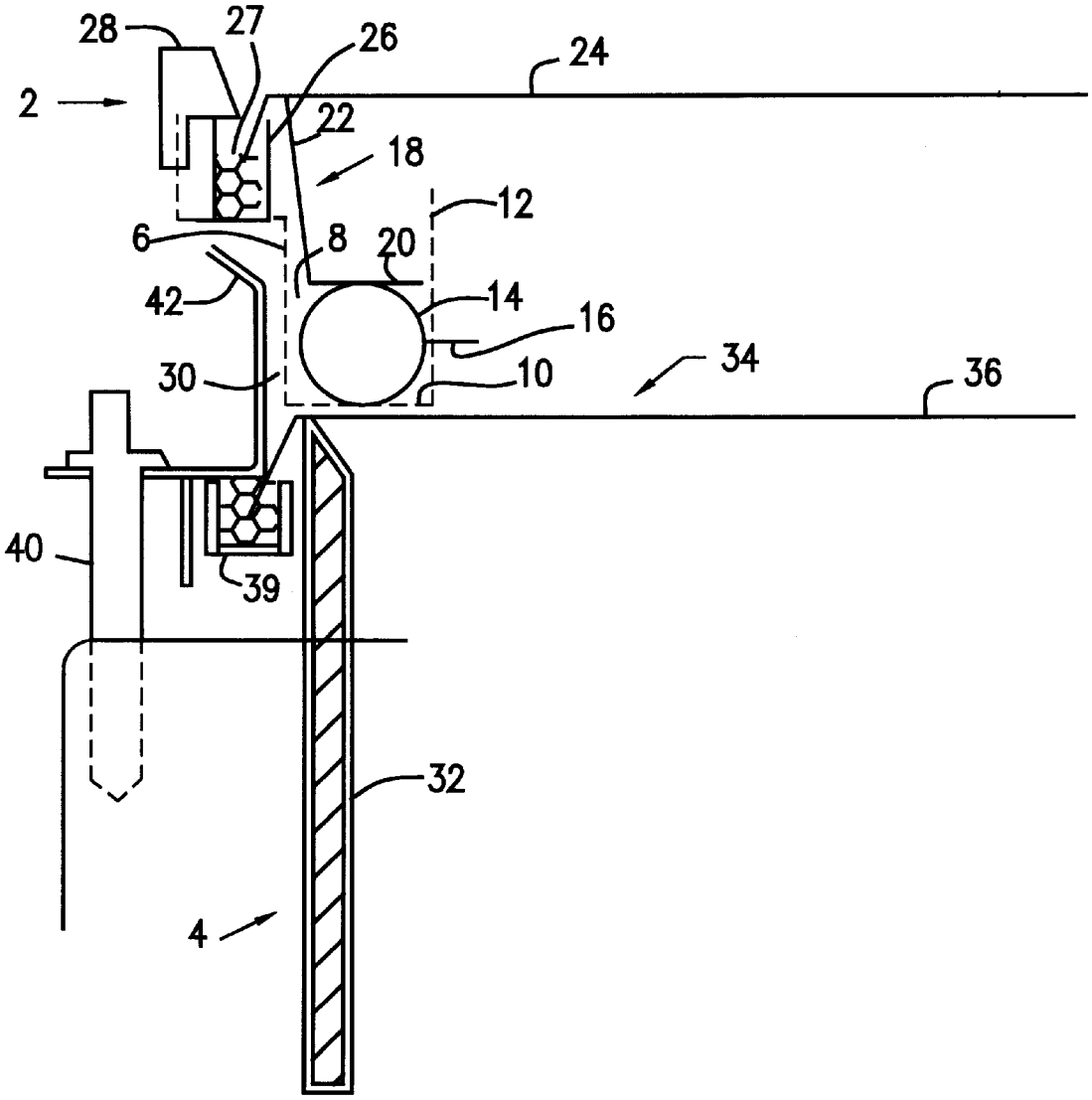
FIG. 1 is a sectional elevational view of a drum of the present invention mounted on a conventional acoustic drum illustrating a form in which the drum of the present invention can be used in one instance as a practice drum.

As seen in FIG. 1, an inflatable bladder assembly 2 is shown attached to a conventional drum 4 and is intended principally to function as a practice drum.

The inflatable bladder assembly 2 is comprised of an aluminum frame 6 having an interiorly disposed channel 8, preferably of aluminum rigidly attached to the frame 6. Other materials such as plastic or wood could be used. The channel 8 is configured with a horizontal surface 10 and vertical surface 12, which vertical surface forms an inner ring with the assembly 2 and is circularly configured. An inflatable bladder 14, preferably pneumatic, provided with a conventional inflation valve 16 is disposed within the channel 8 and rests on the horizontal surface 10 of the channel 8. A slidably mounted pressure plate 18 having a horizontal surface 20 bearing on the bladder 14 and a vertically extending member 22 the top of which bears against the inner surface of the head 24. The head 24 is secured to the assembly 2 by means of a peripheral channel member 26 in which epoxy 27 or other conventional drum head receiving means are contained to rigidly fix the periphery of the head 24 to the channel member 26. A conventional lug 28 affixed to the frame 6 secures the head 24 to the frame 6.

A peripheral gasket 30 on the exterior of the frame 6 is provided to releasably secure the assembly 2 of a conventional drum 4.

The conventional drum 4 is comprised generally of a drum shell 32, a drum head assembly 34 formed of the head 36 and retaining ring 38, a tensioning rod assembly 40 and a counter hoop 42.

In the embodiment of FIG. 1, the gasket 30 is a D-shaped gasket of flexible polyvinyl chloride Shore 50 A durometer, however, other means for providing a force fit between the assembly 2 and the counterhoop 42 such as foam gaskets or mechanical fasteners can be used. Practice has taught that a suitable material for the pressure plate 18 is one-sixteenth inch aluminum angle stock.

In operation the musician inflates the bladder 14 through the valve 16 by an inflation means to impose a pressure on the pressure plate 18 that will transmit a tensioning force to the drum head 24 that will provide a tension that the musician desires to obtain for practicing. Usually the musician will choose a tension that matches the tension equivalent to the tension he uses on his acoustic drums.

It is contemplated that the head used in the practice drum will be a mesh head to reduce or minimize noise.

Figure 2:
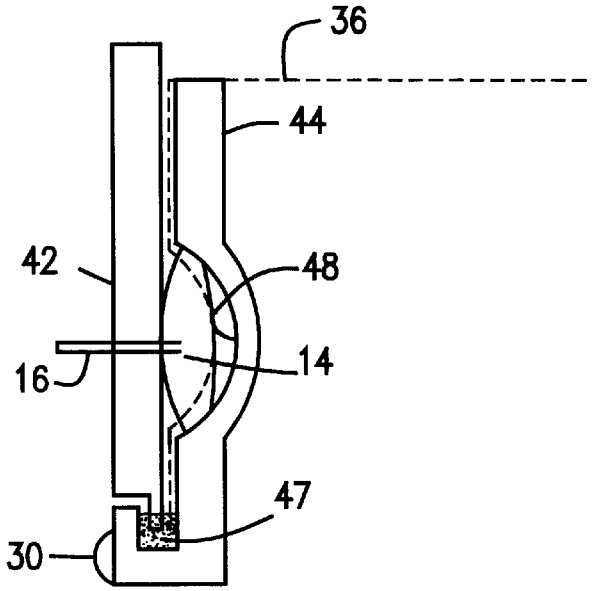
FIG. 2 is another embodiment of a drum of the present invention shown in cross-sectional elevational view which can be mounted on a conventional drum.

The embodiment of FIG. 2 is another illustration of a drum of the present invention. In the embodiment of FIG. 2, an outer shell 42 is shown connected to an inner shell 44. The drum head 36 is arranged to fit over the inner shell 44 around a recess 48 in the inner shell 44 and into the epoxy 47. The bladder 14 is essentially the same as the bladder 14 of the embodiment of FIG. 1 but is shown located in the recess 48 in the inner shell 44 and upon inflation urges the head material 36 into the recess 48 and against the recess 48 thereby tensioning the head 36. The inflation valve 16 is shown extending outwardly through the outer shell 42 however it can be arranged to extend inwardly through the inner shell 44. Again a gasket 30 is provided to enable attachment of the practice drum to a conventional drum.

Figure 3:
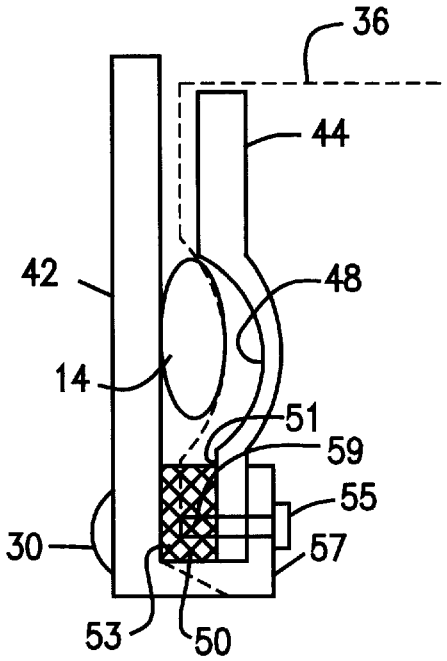
FIG. 3 is a further embodiment of a drum of the present invention adapted to be mounted on a conventional drum and also shown in cross-sectional elevational view.

The embodiment of FIG. 3 is a further modification of the drum of FIG. 1 again illustrated by an outer shell 42 and an inner shell 44, the inner shell 44 being provided with a recess 48. The mesh or solid head 36 again is stretched over the inner shell 44 around the recess 48 in the inner shell. The head material is secured by a clamping ring 50 located at the bottom of the connection between the inner and outer shell. The clamping ring 50 is an aluminum case 51 filled with epoxy 53 that secures the head 36. A bolt or screw 55 passes through a flange 57 and into threads 59 in the clamping ring 50 to secure the assembly. Again the bladder 14 is similar to the bladder 14 of the previous practice embodiments and fits within the recess 48 within the inner shell 44. A gasket 30 or similar means is provided to enable attachment of the practice drum assembly to a conventional drum.

Figure 4:
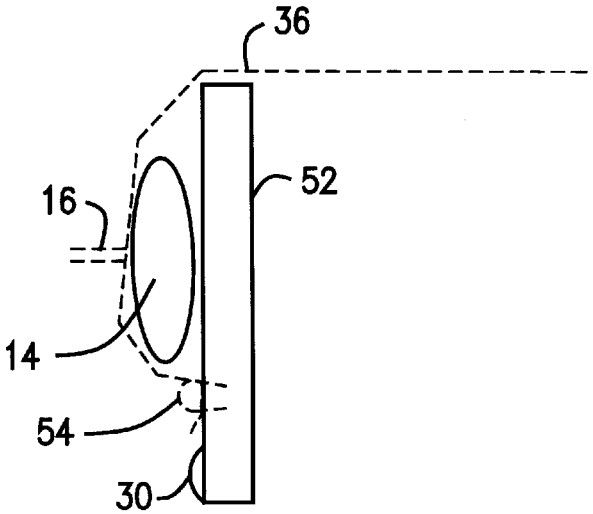
FIG. 4 is yet another embodiment of a drum of the present invention shown in sectional elevational view adapted to be mounted on a conventional drum.

The embodiment of FIG. 4 is a further simplified form of the drum embodiment of the present invention and is comprised of a shell 52, a head 36 stretched over the exterior of the shell 52 and secured to the shell 52 by a plurality of spaced-apart staples 54. In this embodiment the bladder 14 and bladder valve stem 16 are on the exterior of the shell and the head 36 is stretched around the exterior of the bladder 14. Operation of the assembly to provide adjustable tension on the head 36 occurs by inflating and deflating the bladder 14 which directly imposes a tension on the head 36, thereby eliminating any need for additional parts such as a pressure plate.

Figure 5:
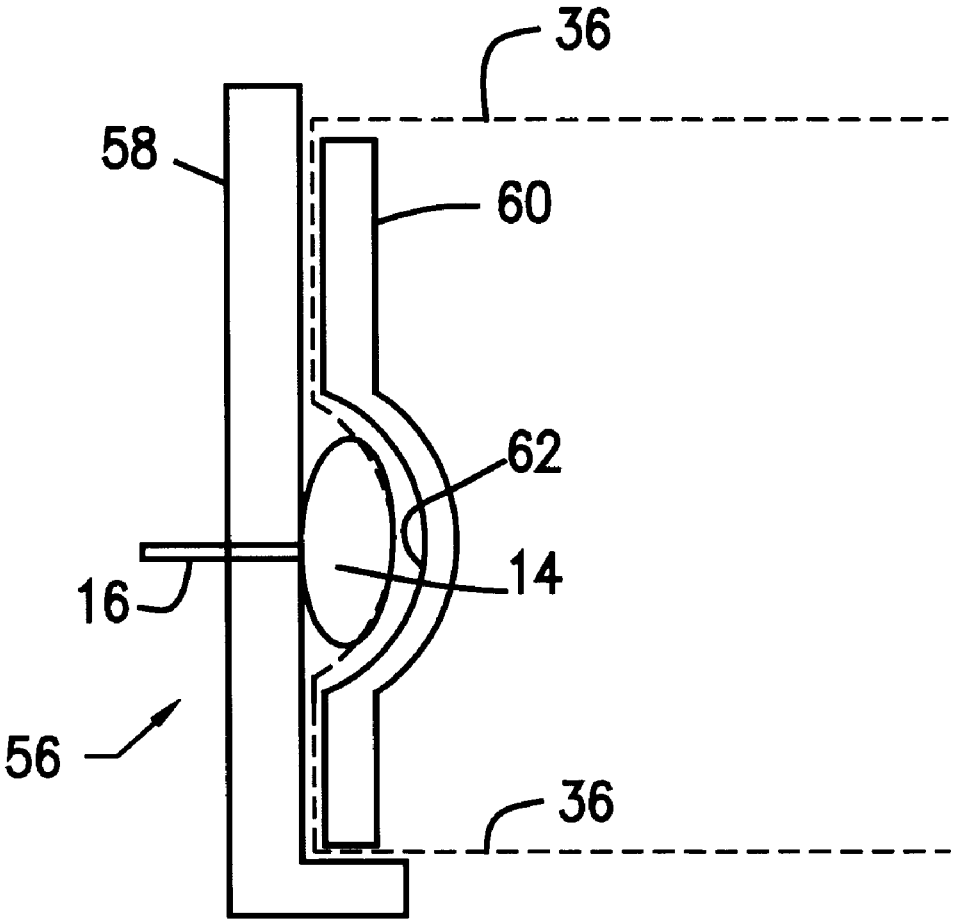
FIG. 5 is a sectional elevational view of a drum of the present invention illustrating use as either a practice drum or an acoustic drum depending on the head material selected.
Figure 6:
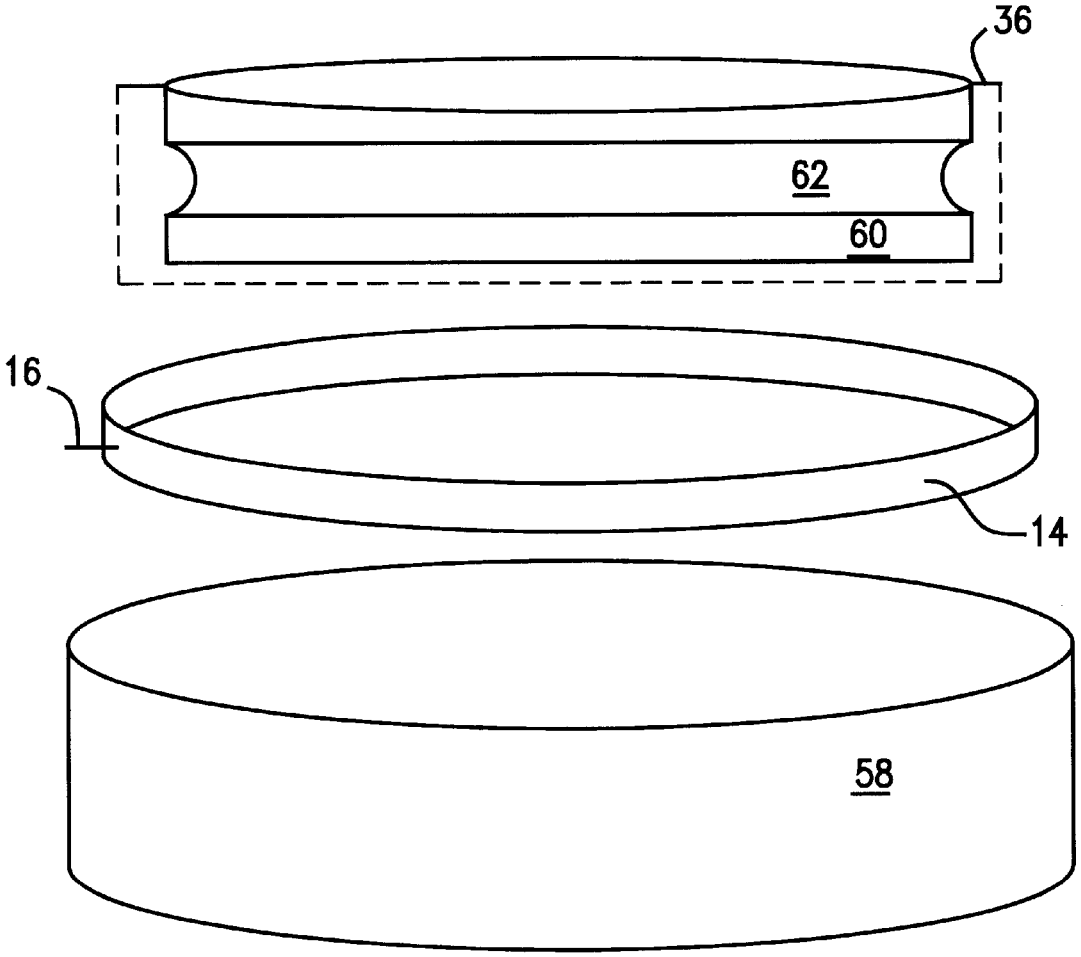
FIG. 6 is an exploded view of the drum shown in FIG. 5.

As best seen in FIG. 5 a two headed drum 56; i.e. a drum having a battering head and a resonance head is provided with the bladder assembly of the present invention. The drum 56 is comprised of an outer shell 58, an inner shell 60 having a centrally disposed recess 62 and a bladder 14 fitting within the recess 62. The drum head 36 is a continuous piece and extends from the top of the drum over the inner shell 60 around the bladder 14 and around the bottom of the inner shell 60 thereby providing a drum that can be used as either a practice drum or an acoustic drum depending on the head material used. As seen in FIG. 6 the drum 56 of FIG. 5 is shown in an exploded view with the outer shell 58, bladder 14, inner shell 60 and head 36.

Figure 7:
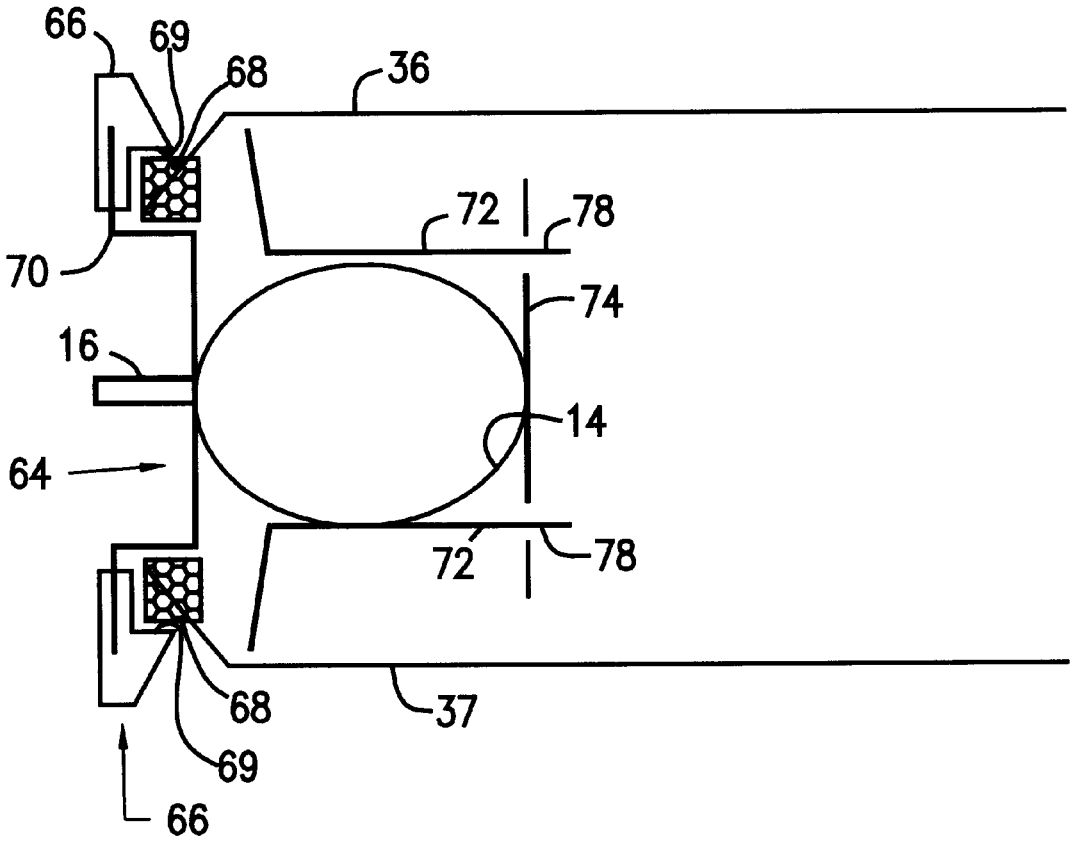
FIG. 7 is another embodiment of a drum provided with the inflatable bladder of the present invention.
Figure 8:
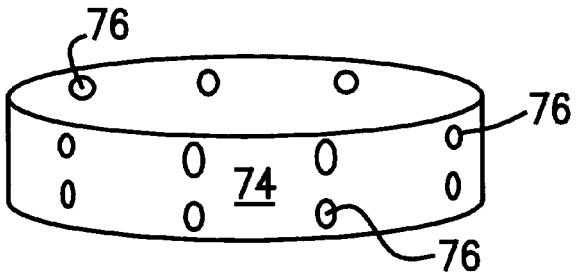
FIG. 8 is a perspective view of the inner ring of the drum shown in FIG. 7.

A further embodiment of a two headed drum 64 employing the inflatable bladder of the present invention is shown in FIG. 7. Therein the top head 36 and bottom head 37 rather than being continuous are shown with a conventional clamping ring 68 embedding the head in epoxy. The top head 36 and bottom head 37 are secured to the drum by an outer frame 70 having rim gaskets 66 configured with tongues 69 to capture the clamping rings 68. The bladder assembly is provided with two pressure plates 72, one bearing against the upper head 36 and one bearing against the lower head 37. An inner ring 74 arranged to provide a reaction force for the bladder 14 is also provided. The inner ring 74, as seen in FIG. 8, is provided with guide slots 76 into which the extremities 78 of the pressure plates 72 fit. As the bladder 14 is inflated the pressure plates 72 travel in the guide slots 76 to impose pressure on the upper and lower heads. In this embodiment the valve 16 extends outwardly through the drum shell outer frame 70. The rim gaskets 66 can be formed of semi-flexible material such as modified polyvinyl chloride to enable release of the drum heads 36 and 37 from the drum 64. The semi-flexible rim gaskets 66 can be bent away from the drum by a screwdriver or other implement to the extent that the tongue 69 is disengaged from the clamping ring 68 thereby enabling the drum head to be removed from the drum 64.

As can be seen in the embodiments of FIGS. 6 and 7 the bladder 14 of the present invention provides for virtually identical tensioning at all points on the top and bottom drum heads. This feature is in many ways superior to that of a conventional lug and tension assembly in that a single force imposed provides essentially uniform pressure on the drum heads rather than discrete tension points required by a conventional lug assembly. Further, the use of a single bladder to provide drum tensioning eliminates the cost attendant a conventional tension rod and lug assembly which normally requires multiple rods and lugs. In addition, a less expensive shell can be used with the inflatable bladder of the present invention because force is distributed equally to the shell unlike rod and tension assemblies that rely on localized forces.

What is claimed is:

1. A musical drum comprised of a drum body; a drum head secured to the drum body; an inflatable bladder secured to the drum body; means for imposing tension on the drum head in response to inflation of the inflatable bladder and means for inflating the inflatable bladder, wherein said drum is a practice drum and further comprises means for attaching the practice drum to a conventional drum comprising a gasket formed on the exterior of the practice drum body extending a distance from the practice drum body to create a force fit on a surface extending from the conventional drum beyond the conventional drum head.

2. A drum as in claim 1 wherein the means for inflating the inflatable bladder is an inflation valve; the inflatable bladder is a pneumatic bladder and further comprising and inflation-deflation valve stem.

3. A practice drum as in claim 1 wherein the gasket is formed of polyvinyl chloride.

4. A practice drum as in claim 1 wherein the gasket is a foam gasket.

5. A drum as in claim 1 wherein the drum is a two headed drum.

6. A drum as in claim 5 further comprising a continuous drum head covering extending over the top, bottom and sides of the drum and over the inflatable bladder.

7. A drum as in claim 1 wherein the drum head is comprised of mesh.

8. A musical drum comprised of a drum body; a drum head secured to the drum body; an inflatable bladder secured to the drum body; means for imposing tension on the drum head in response to inflation of the inflatable bladder and means for inflating the inflatable bladder, wherein the means to impose tension on the drum head is a structure slidably mounted on the drum body having a surface bearing against the bladder on the surface of the bladder facing the drum head and a surface bearing against the drum head and wherein the means for securing the inflatable bladder to the drum body is a flange extending interiorly from the drum body on which the inflatable bladder rests and the inflatable bladder is continuous.

9. A drum as in claim 8 wherein the drum head is comprised of mesh.

10. A practice drum head assembly comprising a circular continuous rigid structure having a top, bottom and side; a recess in the exterior of the side surface of the continuous rigid structure; a drum head covering the top and side of the rigid structure, a continuous inflatable bladder located on the side of the rigid structure in alignment with the recess in the exterior of the side of the continuous rigid structure and means to secure the drum head to the drum head assembly, and wherein the side surface is an inner shell and further comprising an outer shell surrounding the side surface and means for securing the outer shell to the inner shell, and further comprising a means for securing the practice drum head assembly to a conventional drum comprising a continuous gasket on the exterior of the rigid structure.

11. A drum head assembly as in claim 10 wherein the means for securing the drum head to the drum head assembly is comprised of a plurality of spaced apart staples.

12. A drum as in claim 10 wherein the drum head is comprised of mesh.

13. A musical drum comprised of a drum body; a drum head secured to the drum body; an inflatable bladder secured to the drum body; means for imposing tension on the drum head in response to inflation of the inflatable bladder and means for inflating the inflatable bladder, wherein said drum is a two headed drum comprising a continuous drum head extending over the top, bottom and sides of the drum and over the inflatable bladder and further comprising an inner shell, a recess in the inner shell and wherein the inflatable bladder is located in said recess.

14. A drum as in claim 13 further comprising a top head and a bottom head secured to the drum body and an internal inflation assembly comprised of an inner ring, guide slots in the inner ring, pressure plates the extremities of which are inserted in the guide slots and an inflatable bladder mounted in the inflation assembly to impose force on the pressure plates upon inflation of the bladder.

15. A drum as in claim 14 wherein the top head is a battering head and the bottom head is a resonant head.

16. A drum as in claim 14 wherein one head is comprised of a mesh head.

17. A drum as in claim 15 wherein the drum head is comprised of mesh.

* * * * *